United States Patent [19]

Tajima et al.

[11] Patent Number: 4,636,414

[45] Date of Patent: Jan. 13, 1987

[54] LAMINATED BITUMINOUS ROOFING MEMBRANE

[75] Inventors: Eiichi Tajima; Kaname Yamamoto, both of Tokyo, Japan

[73] Assignee: Tajima Roofing Co., Ltd., Tokyo, Japan

[21] Appl. No.: 646,668

[22] Filed: Aug. 31, 1984

[30] Foreign Application Priority Data

Sep. 12, 1983 [JP] Japan ..... 58-166749

[51] Int. Cl.[4] ..... B32B 3/00; B32B 11/00

[52] U.S. Cl. ..... 428/40; 428/143; 428/195; 428/291; 428/489

[58] Field of Search ..... 428/141, 143, 40, 195, 428/489, 291

[56] References Cited

U.S. PATENT DOCUMENTS

| | | | |
|---|---|---|---|
| 3,813,280 | 5/1974 | Olszyk et al. | 428/489 |
| 3,903,340 | 9/1975 | Shepherd | 428/143 |
| 4,091,135 | 5/1978 | Tajima et al. | 428/489 |

FOREIGN PATENT DOCUMENTS

| | | | |
|---|---|---|---|
| 2107246A | 4/1983 | United Kingdom | 428/489 |
| 2107608A | 5/1983 | United Kingdom | 428/489 |

*Primary Examiner*—Paul J. Thibodeau

*Attorney, Agent, or Firm*—Flynn, Thiel, Boutell & Tanis

[57] ABSTRACT

A laminated bituminous roofing membrane including: (i) a fibrous sheet; (ii) a first bituminous layer laminated on one surface of the fibrous sheet, the bituminous layer being composed of bitumen or a bituminous mixture; (iii) a synthetic resin sheet or film laminated on the other surface, opposite to the surface laminated to the fibrous sheet, of the first bituminous layer; (iv) a second bituminous layer laminated on the other surface of the fibrous sheet, the bituminous layer being composed of bitumen or a bituminous mixture; and (v) a mineral aggregate layer deposited on the opposite surface of the second bituminous layer.

This laminated bituminous roofing membrane can be readily and directly applied in a cold-application process on a substrate to form a waterproofing layer in which the joint portions of adjacent roofing membranes are completely water-tightly bonded and the formation of blistering and deterioration due to the presence of moisture or water from the substrate is prevented.

12 Claims, 5 Drawing Figures

LAMINATED BITUMINOUS ROOFING MEMBRANE

BACKGROUND OF THE INVENTION

1. Field of the Invention

The present invention relates to a laminated bituminous roofing membrane suitable for use in cold-application type roofing, waterproofing, or dampproofing work in building construction or civil engineering. More specifically, it relates to a laminated bituminous roofing membrane particularly suitable for use in cold application type formation of a single roofing, waterproofing, or dampproofing layer. The term "bituminous" and "bitumen", as used hereinbelow, may be replaced by the term "asphalt".

2. Description of the Prior Art

Heretofore, as is well-known in the art, bituminous roofing membranes or synthetic polymer type roofing sheets have generally been used for roofing, waterproofing, or dampproofing work in building construction or civil engineering.

In one process, in use for a long period of time, two or more layers of bituminous roofing membranes or sheets are laminated at a construction site using hot molten bitumen to form a continuously integrated multilayer roofing or waterproofing layer.

In another process, synthetic polymer type roofing sheets, such as vulcanized rubber sheets, unvulcanized rubber sheets, or synthetic resin sheets, are applied to a substrate while bonding the adjacent sheets to each other at the joint portions thereof to form a substantially single waterproofing layer.

In such waterproofing processes, the waterproofing membranes or sheets themselves must have high durability; the water-tight bonding of the joint portions between adjacent membranes or sheets must be complete; and, if no protective layer such as concrete or gravel is applied over the waterproofing layer, i.e., the waterproofing layer is finished in an exposed state (i.e., exposure-to-the weather type process), no blistering may be caused by vapor pressure of water flowing up through a substrate.

In conventional bituminous waterproofing application processes, although the desired water-tight bonding of the joint portions of the adjacent waterproofing membrane or sheets can be relatively readily effected by using an adhesive composed of a material identical to, or similar to, the bituminous material of the waterproofing membranes or sheets, the conventional bituminous waterproofing membranes or sheets per se have the disadvantage of insufficient durability. To make up for this, a plurality of the bituminous waterproofing membranes or sheets are laminated in, for example, a thickness of about 5 mm to about 10 mm.

This necessitates a large amount of materials and man-hours and, therefore, increases the materials cost and man-power cost required in the waterproofing application processes.

On the other hand, the above-mentioned various kinds of synthetic polymer type waterproofing sheets are generally used in the form of a single layer having a thickness as thin as 1.0 mm to 2.0 mm. Of these sheets, vulcanized rubber sheets are most widely used due to the excellent mechanical strength and weathering properties (or weather resistance) thereof. However, there is the problem of insufficient bonding strength, particularly the durability thereof, of adjacent vulcanized rubber sheets when such sheets are successively applied onto a substrate. Therefore, water leakage often occurs at the joint portions. This is caused by the poor adhesion properties of the sheets due to the vulcanization of the rubber and the absence of appropriate adhesives.

SUMMARY OF THE INVENTION

Accordingly, the objects of the present invention are to eliminate the above-mentioned problems in the prior art and to provide a laminated bituminous roofing membrane having high durability suitable for use in cold-application type roofing, waterproofing, or dampproofing work in building construction or civil engineering.

Another object of the present invention is to provide a laminated bituminous roofing membrane capable of completely water-tightly bonding the joint portions of adjacent roofing membranes and also capable of preventing the formation of blistering and deterioration in the waterproofing layer due to the presence of moisture or water from a substrate.

Other objects and advantages of the present invention will be apparent from the following description.

In accordance with the present invention, there is provided a laminated bituminous roofing membrane comprising: (i) a fibrous sheet; (ii) a first bituminous layer laminated on one surface of the fibrous sheet, the bituminous layer being composed of bitumen or a bituminous mixture; (iii) a synthetic resin sheet or film laminated on the other surface, opposite to the surface laminated to the fibrous sheet, of the first bituminous layer; (iv) a second bituminous layer laminated on the other surface of the fibrous sheet, the bituminous layer being composed of bitumen or a bituminous mixture; and (v) a mineral aggregate layer deposited on the opposite surface of the second bituminous layer.

BRIEF DESCRIPTION OF THE DRAWING

The present invention will be better understood from the description set forth below with reference to the accompanying drawings illustrating, but is not intended to be limited to, the preferred embodiments of the present invention, in which.

DESCRIPTION OF THE PREFERRED EMBODIMENT

Figure 1:
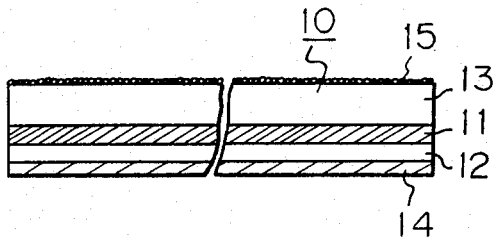
FIG. 1 is a cross-sectional view of the structure of a first embodiment of the laminated bituminous roofing membrane according to the present invention.

The basic structure of the laminated bituminous roofing membrane 10, as shown in FIG. 1, comprises a fibrous sheet 11 optionally impregnated with bitumen or a bituminous mixture, first and second bituminous layers 12 and 13 laminated on both surfaces of the fibrous sheet 11, a synthetic resin sheet or film (i.e., "synthetic resin sheet" hereinbelow) 14 laminated on the opposite surface of the first bituminous layer 12, and a mineral aggregate layer 15 deposited on the opposite surface of the second bituminous layer 13.

The inventors conducted extensive studies as to the deterioration phenomena of built-up system waterproofing layers based on conventional bituminous roofing membranes. As a result, the inventors found that conventional bituminous waterproofing layers deteriorate not only due to actions of ultraviolet light, heat, and oxidation, but also due to water, particularly alkaline water flowing up from substrate concrete. It is known in the art that the deterioration of the waterproofing layers mainly proceeds from the upper surface of the waterproofing layers by action of ultraviolet light, heat, and oxidation. However, according to the inventors' study on the deterioration conditions of exposed bituminous waterproofing layers after 10 to 20 years, it was unexpectedly found that the ratio of the deterioration degree of the upper surfaces of the waterproofing layers to that of the lower surfaces is approximately 6:4 on the average, although the ratio varies depending upon, for example, types of roofing materials and environmental conditions of buildings. The deterioration of the conventional bituminous waterproofing layers from the lower surfaces thereof is caused by the facts that the lowermost bitumen layer is first hydrolyzed by the alkaline water from the substrate to become brittle and water-absorbable and, then, fibrous base sheets such as rag felts, synthetic non-woven fabrics, and glass fiber mats generally used in conventional roofing sheets deteriorate due to the action of the alkaline water. When the base sheets deteriorate as mentioned above, the desired principal characteristics, such as repeated fatigue resistance, dimensional stability, and watertight properties, of the waterproofing layers are impaired. Accordingly, in order to achieve a single layer bituminous waterproofing process, it is an important to prevent the above-mentioned deterioration of the bituminous waterproofing layer caused by the alkaline water from the lower surface.

According to the present invention, this can be effectively attained. Thus, the synthetic resin sheet layer 14 of the present laminated bituminous roofing membrane 10 is provided at the portion where the membrane 10 contacts the substrate. Furthermore, the fibrous sheet 11 is included in the roofing membrane 10. Therefore, a waterproofing layer having excellent repeated fatigue resistance and dimensional stability can be formed from the present roofing membrane.

The fibrous sheets usable in the present invention include, for example, in addition to conventional cardboard, woven fabrics, knitted fabrics, and non-woven fabrics made of glass fiber, asbestos fiber, and synthetic fibers such as polyvinyl alcohol fiber, polypropylene fiber, polyester fiber, and polyamide fiber. These fibrous sheets are preferably reinforced with an appropriate reinforcing material. When the dimensional stability is important, the use of glass fiber mats or woven fabrics made of glass fiber is particularly preferable. These fibrous sheets are optionally impregnated with bitumen or a bituminous mixture (e.g., a mixture of bitumen and rubbers and/or resins).

The synthetic resin sheets are used in the present invention to prevent the deterioration of the waterproofing layer due to alkaline water from substrate concrete, as mentioned above. Accordingly, the synthetic resin sheets usable in the present invention are those made of any synthetic resins having sufficient alkaline water resistance. Examples of such synthetic resins are polyvinyl chloride, polyethylene, polypropylene, polyester, polycarbonate, polyvinyl alcohol, acrylic resins, ethylene-vinyl acetate copolymers, and chlorinated polyethylene. From a practical point of view, so-called cross-laminated type polyethylene sheets are preferably used, since these types of polyethylene sheets have, in addition to excellent alkaline water resistance, excellent mechanical strengths and economical advantages. The cross-laminated type polyethylene sheets are those prepared by cross-laminating a plurality of polyethylene films which are obtained by being molecular orientated along the stretching direction while stretching in one direction.

The thickness of the synthetic resin sheets used in the present invention may vary over a wide range, but will practically be in the range of from 0.01 mm to 0.5 mm, preferably in the range of from 0.05 mm to 0.2 mm.

The bituminous layers used in the present invention are those composed of bitumen or bituminous mixtures. These bituminous layers may be formed by coating the fibrous sheet with bitumen or bituminous mixtures. Any bitumen such as straight asphalt or blown asphalt may be used in the present invention. However, bituminous mixtures such as rubber-modified bitumen and resin-modified bitumen can be preferably used taking into account the weathering properties of the finished roofing membrane and the bonding properties thereof with synthetic resin sheets to be laminated thereon.

The above-mentioned rubber-modified bitumens are denatured to impart thereto weathering properties, thermal aging resistance, high temperature characteristics, and low temperature characteristics by blending rubber into bitumen. Examples of the rubber are natural rubber or various conventional synthetic rubbers such as styrene-butadiene rubber, acrylonitrile-butadiene rubber, butadiene rubber, isoprene rubber, chloroprene rubber, butyl rubber, ethylene-propylene rubber, ethylene-propylene-diene mar, polyisobutylene, SBS (styrene-butadiene-styrene block copolymer), and SIS (styrene-isoprene-styrene block copolymer). The reclaimed rubber of these rubbers can also be used in the present invention. These rubbers can be used in an unvulcanized or vulcanized state alone or in any mixture thereof.

The rubber can be generally compounded into the rubber-modified bitumen in an amount of 3% to 50% by weight, preferably 10% to 30% by weight. When the compounding amount of the rubber is too small, the desired modification cannot be attained. Contrary to this, the compounding amount of the rubber is too large, the above-mentioned modification can be remarkably attained, but the processability (or workability) of the rubber-modified bitumen is decreased, causing difficulties in the lamination or coating operation. Furthermore, an appropriate amount of a processing aid such as process oil can be effectively added to the rubber-modified bitumen, depending upon the compounding amount of the rubber, to improve the processability. Still furthermore, compounding agents, conventionally used in processing of rubber, plastics, and bitumen, such as tackifiers, softening agents, anti-oxidants, and antiaging agents can be used for improving various characteristics of the rubber-modified bitumen.

The above-mentioned resin-modified bitumen can be prepared by compounding resins, in lieu of the rubbers, to bitumen. Examples of such resins are conventional thermoplastic resins such as polyethylene, polypropylene, acrylic resins, chlorinated polyethylene, and ethylenevinyl acetate copolymers. Of these resins atactic polypropylene is preferably used in the practice of the present invention in view of the compatibility thereof to bitumen and economic advantages. The resin can be generally compounded into the resin-modified bitumen in an amount of 3% to 50% by weight, preferably 10% to 30% by weight.

The first and second bitumen layers may be composed of the same or different bitumen or bituminous mixture. Furthermore, both the rubber and the resin can be compounded into the bitumen.

The mineral aggregate layer 15 deposited on the second bituminous layer 13 in FIG. 1 can be composed of any mineral granules or powder particles generally used in conventional bituminous roofing membranes or sheets. Examples of such mineral granules or powder particles are talc, calcium carbonate, silica sand, mica, and vermiculite. These mineral granules or powder particles prevent undesirable blocking of the bituminous roofing membrane during the production, storage, transportation, handling, and application thereof and also inhibit the deterioration of the laminated bituminous roofing membranes due to ultraviolet light and oxidation after their application in construction sites. In addition, river sand, sea sand, crushed stone, and similar mineral granules or powder can be used, in lieu of the abovementioned mineral granules or powder particles, in the present invention.

The total thickness of the laminated bituminous roofing membranes according to the present invention may vary over a wide range, but will generally be in the range of from 1 to 5 mm, preferably 1.5 to 3 mm. Furthermore, the distance between the fibrous sheet and the synthetic resin sheet, i.e., the thickness of the first bituminous layer, cannot be generally specified depending upon the total thickness of the laminated bituminous roofing membrane. However, when this distance is too wide, the flexibility of the entire membrane is impaired, whereby wrinkles are likely to be caused in the product membranes when rolling them up. Thus, the thickness of the first bituminous layer is preferably 1 mm or less, more preferably 0.5 mm or less.

The laminated bituminous roofing membranes of the present invention as embodied in FIG. 1 can be readily applied at a construction site in a similar manner as in conventional synthetic polymer roofing sheets. For example, the laminated bituminous roofing membranes can be applied or bonded to a substrate by partially or entirely coating, to the substrate, conventional adhesives such as synthetic rubber type adhesives (e.g., butyl rubber, chloroprene rubber, and styrene-butadiene rubber), synthetic resin type adhesives (e.g., acrylic resins and vinyl acetate-ethylene copolymer), and bituminous type adhesives (e.g., bitumen, rubber-modified bitumen, and resin-modified bitumen). Thus, the laminated bituminous roofing membranes can be bonded to substrates at construction sites.

Figure 2:
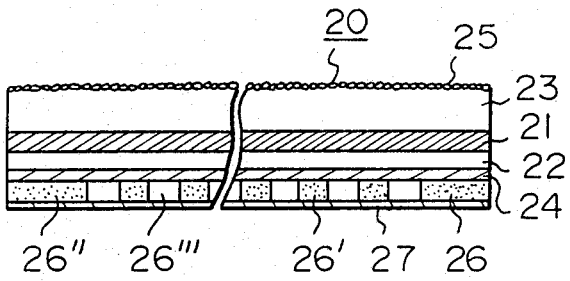
FIG. 2 is a cross-sectional view of the structure of a second embodiment of the laminated bituminous roofing membrane according to the present invention.

As shown in FIG. 2, the laminated bituminous roofing membranes 20 according to the second embodiment of the present invention comprises a fibrous sheet 21 optionally impregnated with bitumen or a bituminous mixture, first and second bituminous layers 22 and 23 laminated on both surfaces of the fibrous sheets 21, a synthetic resin sheet layer 24 laminated on the other surface, opposite to the surface laminated to the fibrous sheet 21, of the first bituminous layer 22, and a mineral aggregate layer 25 deposited on the other surface, opposite to the surface laminated to the fibrous sheet 21, of the second bituminous layer 23, as in the first embodiment of the present laminated bituminous roofing membrane 10. Furthermore, according to the second embodiment shown in FIG. 2, the laminated bituminous roofing membranes 20 further comprises adhesive layers 26, 26', and 26'' partially coated on the other surface, opposite to the first bitumen layer 22, of the synthetic resin sheet layer 24 and a release sheet 27 laminated over the adhesive layers 26, 26', and 26''.

Thus, according to the second embodiment of the present invention, since the adhesive layers 26, 26', and 26'' are partially coated on the synthetic resin sheet layer 24, e.g., in the form of spots, lines, stripes, or bands, the bonding of the roofing membrane to a substrate during the application thereof can be facilitated. Furthermore, the void or empty spaces 26''' formed between the substrate surface and the portion where no adhesive layer is present after the application act as open-cell type spaces (or through-paths) for discharging water vapor generated from the substrate to the outside of the waterproofing layer to effectively prevent blistering of the waterproofing layer in an exposure-to-the weather type application process. At least one adhesive material of the adhesive layers 26 and 26'' coated in the edge portions of the roofing membrane 20 is preferably coated longitudinally in the form of a band for effectively bonding the adjacent roofing membranes to each other.

Examples of the adhesive materials usable in the present roofing membranes are modified bitumen adhesives having a high tackiness even at an ambient temperature, although the other conventional adhesive materials may be used. The above-mentioned modified bitumen adhesives can be prepared by blending bitumen with natural or synthetic rubbers and/or natural or synthetic resins. The typical compositions of the modified bitumen adhesives are 5% to 95% by weight, preferably, 20% to 90% by weight, of bitumen and 5% to 95% by weight, preferably 10% to 80% by weight, of the rubbers and/or the resins.

Typical examples of the rubbers compounded into the modified bitumen adhesives are natural rubber or various synthetic rubbers such as styrene-butadiene rubber, acrylonitrile-butadiene rubber, butadiene rubber, isoprene rubber, chloroprene rubber, butyl rubber, ethylene-propylene rubber, ethylene-propylene-diene mar, polyisobutylene, SBS, and SIS. The reclaimed rubber of these rubbers can also be used in the present invention. Furthermore, these rubbers can be used in an unvulcanized or vulcanized state alone or in any mixture thereof.

The resins compounded, alone or together with the rubber component, into the modified bitumen adhesives are natural or synthetic resin such as, for example, rosin or its derivatives (e.g., estergum), tall oil, coumarone-indene resin, various petroleum resins, and polyolefin (e.g., polybutene). These resins can be used alone or in any mixture thereof.

Furthermore, a portion (e.g., up to 50% by weight) of the rubber and resin components can be optionally replaced by softening agents such as conventional animal and vegetable oils and animal fats and mineral oils, for further increasing the adhesiveness of the modified bitumen adhesives. Examples of such animal and vegetable oils and animal fats are linseed oil, tung oil, sesame oil, cotton seed oil, soyabean oil, olive oil, castor oil, fish oil, whale oil, and beef tallow. Examples of mineral oils are process oil, polymerized high boiling point high aromatic oil, paraffin, liquid paraffin, white oil, and tar.

Although there is no specifical limitation in the thickness of the adhesive material layers, it may generally be in the range of about 0.2 mm to about 1.0 mm. As mentioned above, the adhesive material partially coated at the edge portions 26 and/or 26'' of the present roofing membrane 20 is preferably coated in the form of a longitudinally continuous band having a width of about 5 cm or more, preferably 10 cm to 15 cm, to ensure the effective bonding of the adjacent roofing membranes to each other during the application at a construction site.

The release sheet 27 laminated on the adhesive material layers 26, 26', and 26'' in the present roofing membrane 20 can be any conventional sheet materials which are coated or impregnated with, for example, fluorine-containing resins or silicone resins. The release sheet 27 is used for facilitating the handling of the laminated bituminous roofing membranes having the adhesive layer to prevent blocking or bonding of the product during production, storage, and transportation. This release sheet 27 is removed from the adhesive layer 26, 26', and 26'' at a construction site so as to effect the bonding of the roofing membrane to a substrate.

Figure 3:
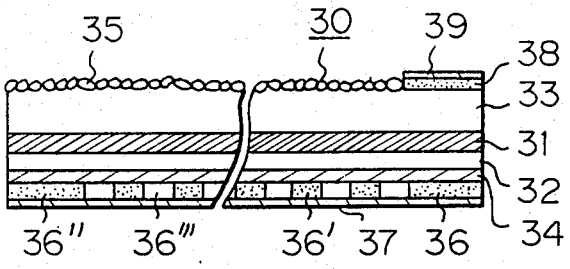
FIG. 3 is a cross-sectional view of the structure of a third embodiment of the laminated bituminous roofing membrane according to the present invention.

As shown in FIG. 3, the laminated bituminous roofing membrane 30 according to the third embodiment of the present invention comprises: a fibrous sheet 31 optionally impregnated with bitumen or a bituminous mixture; first and second bituminous layers 32 and 33 laminated on both surfaces of the fibrous sheets 31; a synthetic resin sheet layer 34 laminated on the other surface, opposite to the surface laminated to the fibrous sheet 31, of the first bituminous layer 32; adhesive layers 36, 36', and 36'' partially coated on the other surface, opposite to the first bitumen layer 32, of the synthetic resin sheet layer 34 and a release sheet 37 laminated over the adhesive layers 36, 36', and 36''; and a mineral aggregate layer 35 deposited on the other surface, opposite to the surface laminated to the fibrous sheet 31, of the second bituminous layer 33, as in the second embodiment of the present laminated bituminous roofing membrane 30. However, according to this embodiment, at least one edge portion, if necessary, both edge portions, of the mineral aggregate layer 35 is replaced with a laminated adhesive material layer 38 and a release sheet 39 laminated thereon for anti-blocking. Thus, according to the embodiment shown in FIG. 3, since the adhesive material layer 38 is mounted along at least one edge portion of the upper surface of the laminated bituminous roofing membrane 30, the water-tight bonding of the joint portions of the roofing membranes can be more completely effected by overlapping the adjacent roofing membranes 30 so as to contact the exposed adhesive layer 38 of one roofing membrane 30 with the adhesive layer 36'' of the adjacent roofing membrane 30 after removing the release sheet 39 from the roofing membranes 30 at a construction site, when a plurality of the roofing membranes 30 are applied in parallel to a substrate in a partially overlapped fashion. In this case, the width of the adhesive layer 36'' is preferably equal to, or larger than, that of the adhesive layer 38.

Figure 4:
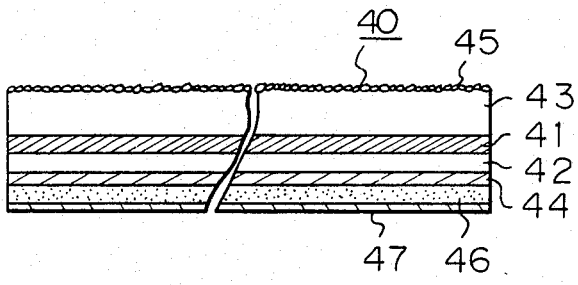
FIG. 4 is a cross-sectional view of the structure of a fourth embodiment of the laminated bituminous roofing membrane according to the present invention.

As shown in FIG. 4, the laminated bituminous roofing membrane 40 according to the fourth embodiment of the present invention comprises: a fibrous sheet 41 optionally impregnated with bitumen or a bituminous mixture, first and second bituminous layers 42 and 43 laminated on both surfaces of the fibrous sheet 41, a synthetic resin sheet 44 laminated on the other surface, opposite to the fibrous sheet 41, of the first bituminous layer 42, and a mineral aggregate layer 45 deposited on the other surface, opposite to the fibrous sheet 41, of the second bituminous layer 43, as shown in FIG. 1. However, in this embodiment, the roofing membrane 40 further comprises an adhesive material layer 46 entirely coated on the other surface, opposite to the first bitumen layer 42, of the synthetic resin sheet layer 44 and a release sheet 47 for an anti-blocking purpose laminated on the adhesive material layer 46.

Thus, according to the fourth embodiment of the present invention shown in FIG. 4, since the roofing membrane 40 can be entirely bonded, via the adhesive material layer 46, to a substrate at a construction site, the roofing membrane 40 can be advantageously used in the case where the roofing, waterproofing, or dampproofing layers must be completely bonded to substrates as in waterproofing of civil construction structures and indoor waterproofing (or dampproofing) of buildings. This type of roofing membrane according to the present invention can also be advantageously used in the case where there is no fear of undesirable blistering of the waterproofing layer, e.g., the roofing membrane is used in non-exposed waterproofing provided with a protective layer such as concrete or gravel, or the roofing membrane is applied to steel deck or a thermal insulating material layer even in an exposed-to-the weather fashion.

Figure 5:
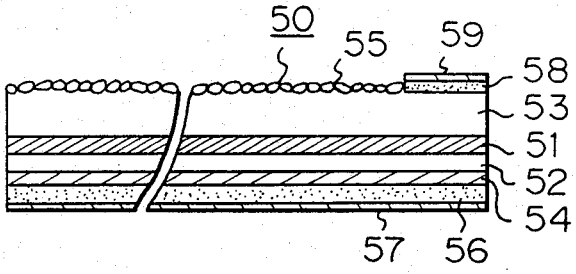
FIG. 5 is a cross-sectional view of the structure of a fifth embodiment of the laminated bituminous roofing membrane according to the present invention.

As shown in FIG. 5, the laminated bituminous roofing membrane 50 according to a fifth embodiment of the present invention comprises: a fibrous sheet 51 optionally impregnated with bitumen or a bituminous mixture; first and second bituminous layers 52 and 53 laminated on both surfaces of the fibrous sheets 51; a synthetic resin sheet layer 54 laminated on the other surface, opposite to the surface laminated to the fibrous sheet 51, of the first bituminous layer 52; an adhesive material layer 56 entirely coated on the other surface, opposite to the first bitumen layer 52, of the synthetic resin sheet layer 54; a release sheet 57 laminated thereon; and a mineral aggregate layer 55 deposited the other surface, opposite to the fibrous sheet 51, of the second bituminous layer 53, as in the embodiment shown in FIG. 4. However, according to the embodiment shown in FIG. 5, at least one edge portion, if necessary, both edge portions, of the mineral aggregate layer 55 is replaced with an adhesive material layer 58 laminated on the second bituminous layer 53 and a release sheet 59 laminated thereon for anti-blocking. Thus, according to the embodiment shown in FIG. 5, since the adhesive material layer 58 is mounted along at least one edge portion of the upper surface of the laminated bituminous roofing membrane 50, the water-tightly bonding of the joint portions of the roofing membranes can be more completely effected by overlapping the adjacent roofing membranes 50 so as to contact the exposed adhesive material layer 58 of the roofing membrane 50 with the adhesive material layer 56 of the adjacent roofing membrane 50 after removing the release sheet 59 from the roofing membranes 50 at a construction site, when a plurality of the roofing membranes 50 are applied in parallel to a substrate in a partially overlapped fashion.

The widths of the adhesive material layers 38 and 58 in the embodiments shown in FIGS. 3 and 5 may vary over a wide range, but will generally be in the range of from 50 mm to 120 mm. Although there is no specified limitation in the width of the roofing membrane according to the present invention, it is generally 0.5 m to 1.5 m, preferably approximately 1 m in view of the convenience of production, handling, storage, and application operations thereof.

As mentioned hereinabove, the laminated bituminous roofing membranes according to the present invention have the following characteristics.

Since the laminated bituminous roofing membranes according to the present invention have a laminated synthetic resin sheet layer on the bottom surface thereof where the membrane contacts a substrate, the deterioration of the bituminous layers and fibrous sheets of the roofing membranes caused, with the lapse of time, by action of alkaline water from substrate concrete can be effectively prevented. Accordingly, the present roofing membrane can be made thinner as compared with the conventional bituminous roofing membranes or sheets. A typical thickness of the present roofing membrane is 1.5 mm to 3.0 mm, although this range is not limitative. Furthermcre, when the above-mentioned rubber- or resin- modified bitumin is used in the formation of the first and second bituminous layers, particularly the second bituminous layer, The total thickness of the present roofing membrane can be made thinner due to the excellent durability of the modified bitumen. From these combined effects, according to the present invention, a single-layer waterproofing process having high reliability, which has not been attained in the art, can be readily accomplished. It will be noted that, since this single-layer waterproofing process can reduce the total thickness of the waterproofing layer to one-third to one-seventh, there is a remarkable saving in materials and man-hours required in waterproofing work. Therefore, the economic merits of the present invention are extremely high.

When the adhesive material layer is partially mounted, in lieu of the mineral aggregate layer, along one edge portion of the mineral aggregate layer on the upper surface of the membrane as shown in FIGS. 3 and 5, the partially overlapped portions of the adjacent roofing membranes can be water-tightly bonded during the application thereof at a construction site. Thus, the problems inherently present in conventional single layer waterproofing processes using synthetic polymer roofing sheets, i.e., insufficient durability, particularly insufficient water-tight bonding in the joint portions of the adjacent roofing sheets, can be completely eliminated according to the present invention.

Furthermore, when the adhesive material layers are partially provided at the bottom surface of the roofing membrane, which directly contacts a substrate, as shown in FIGS. 2 and 3, the partially bonded-type waterproofing layer can be formed by simply placing the roofing membrane on a substrate while the release sheet is removed from the partially laminated adhesive material layers. This partially bonded-type waterproofing layer is advantageous in the formation of exposed-to-the-weather type waterproofing on a substrate concrete. That is, in the exposed waterproofing layer, since the water present in the substrate is vaporized and expands in a space between the substrate and the waterproofing layer after application due to solar heat, undesired peeling-off and blistering often occur locally or entirely in the waterproofing layer which, in turn, causes undesirable deficiencies in the desired waterproofing function. However, according to this embodiment of the present invention (i.e., partial bonding process), the vaporized water effectively escapes to the outside via spaces formed between the substrate, the bottom surface of the roofing membrane, and the partially laminated adhesive material layer. Thus, the above-mentioned peeling-off and blistering problems in the prior art can be completely prevented.

We claim:

1. A laminated bituminous roofing membrane comprising:

(i) a fibrous sheet;

(ii) a first bituminous layer laminated on one surface of the fibrous sheet, said bituminous layer being composed of bitumen or a bituminous mixture;

(iii) a synthetic resin sheet or film laminated on the other surface, opposite to the surface laminated to the fibrous sheet, of the first bituminous layer;

(iv) a second bituminous layer laminated on the other surface of the fibrous sheet, said second bituminous layer being composed of bitumen or a bituminous mixture; and (v) a mineral aggregate layer deposited on the opposite surface of the second bituminous layer.

2. A laminated bituminous roofing membrane as claimed in claim 1, wherein the fibrous sheet is impregnated with bitumen or a bituminous mixture.

3. A laminated bituminous roofing membrane as claimed in claim 1, wherein the fibrous sheet is composed of a woven, unwoven, or knitted fabric made of glass fiber, asbestos fiber, or synthetic fiber.

4. A laminated bituminous roofing membrane as claimed in claim 1, wherein the bituminous layer is a bituminous mixture comprising 50% to 97% by weight of bitumen and 3% to 50% by weight of rubber, resin, or a mixture thereof.

5. A laminated bituminous roofing membrane as claimed in claim 1, wherein the synthetic resin sheet or film comprises polyvinyl chloride, polyethylene, polypropylene, polyester, polycarbonate, polyvinyl alcohol, acrylic resin, ethylene-vinyl acetate copolymer, or chlorinated polyethylene.

6. A laminated bituminous roofing membrane as claimed in claim 5, wherein the polyethylene sheet or film is a cross-laminated type polyethylene sheet or film.

7. A laminated bituminous roofing membrane as claimed in claim 1, wherein the mineral aggregate layer is composed of coarse sand, fine gravel, talc powder, calcium carbonate powder, silica sand powder, mica powder, or vermiculite powder.

8. A laminated bituminous roofing membrane as claimed in claim 1, wherein the membrane further comprises:

(vi) adhesive layer sections coated on and partially covering the opposite surface of the synthetic resin sheet or film, said adhesive sections consisting essentially of a substantially pressure-sensitive self-adhesive composition; and (vii) a release sheet laminated on the opposite surface of the adhesive layer sections.

9. a laminated bituminous roofing membrane as claimed in claim 8, wherein said adhesive layer sections are spaced from each other in such a manner that open-cell spaces are formed therebetween which spaces are open in a direction away from the synthetic resin or film, said spaces extending through the bottom surface of the roofing membrane and opening to the upper surface of a substrate after application at a construction site.

10. A laminated bituminous roofing membrane as claimed in claim 8, wherein said self-adhesive composition consists essentially of 5% to 95% by weight of bitumen and 5% to 95% by weight of rubber, resin, or a mixture thereof.

11. A lamninated bituminous roofing membrane as claimed in claim 8, wherein said release sheet is impregnated or coated with a resin having high releasing property selected from the group consisting of silicone resin and fluorine-containing resin.

12. A laminated bituminous roofing membrane as claimed in claim 8, wherein an adhesive layer and a release sheet thereon are laminated on at least one edge portion of the second bituminous layer, the remainder of which is covered by the mineral aggregate layer, whereby complete water-tight connection of the adjacent two laminated roofing membranes with each other is effected during the application process thereof.

* * * * *